US006958003B2

(12) United States Patent
Hogue

(10) Patent No.: US 6,958,003 B2
(45) Date of Patent: Oct. 25, 2005

(54) CONTROLLING SPECULARITY OF LUMINAIRE AND OTHER REFLECTORS TO OPTIMIZE THEIR OPTICAL PERFORMANCE

(75) Inventor: Marcus Paul Hogue, Melbourne, FL (US)

(73) Assignee: Marcus P. Hogue and Leveta P. Hogue, Melbourne, FL (US); Co-Trustees of The Hogue Family Recovable Living Trust ( * ) Notice: Subject to any disclaimer, the term of this patent is extended or adjusted under 35 U.S.C. 154(b) by 19 days.

(21) Appl. No.: 10/250,129

(22) Filed: Jun. 5, 2003

(65) Prior Publication Data

US 2004/0248504 A1 Dec. 9, 2004

(51) Int. Cl.[7] ..... B24B 1/00; F21V 7/00
(52) U.S. Cl. ..... 451/42; 362/341; 359/900
(58) Field of Search ..... 451/42; 359/900, 359/527, 528; 362/341, 348; 156/99

(56) References Cited

U.S. PATENT DOCUMENTS 5,096,281 A * 3/1992 Windebank et al. ..... 359/900
5,353,231 A * 10/1994 Sasaki et al. ..... 359/900
5,696,625 A * 12/1997 Malifaud et al. ..... 359/459
5,836,668 A * 11/1998 Ishikawa et al. ..... 362/459
6,447,148 B1 * 9/2002 Oikawa et al. ..... 362/347

* cited by examiner

*Primary Examiner*—Hadi Shakeri

(57) ABSTRACT

A method of improving aspects critical to the reflector making process by defining a reflector surface definition of specularity by its solid angle measurement and a repeatable execution process. The controlled specularity on a hardened steel tool is replicated on a reflector by forcing the reflector surface to yield in extra compression yield failure and permanently set the desired specularity in the reflector. Next, a physical as well as analytical model of the reflection behavior, based on the solid angle geometry, is provided.

1 Claim, 7 Drawing Sheets

PRIOR ART

PRIOR ART

PRIOR ART

Figure 2 A
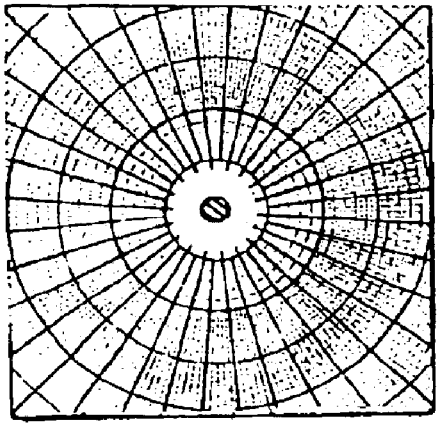
reflected off "steel tool".
Figure 2 B
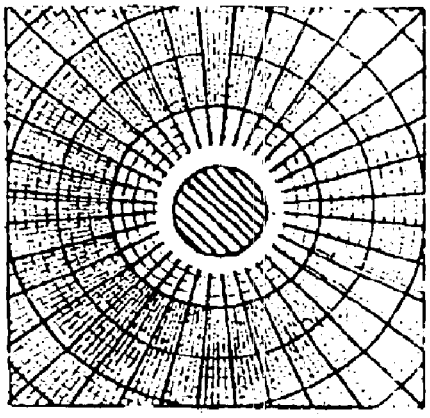
reflected off "current" sample
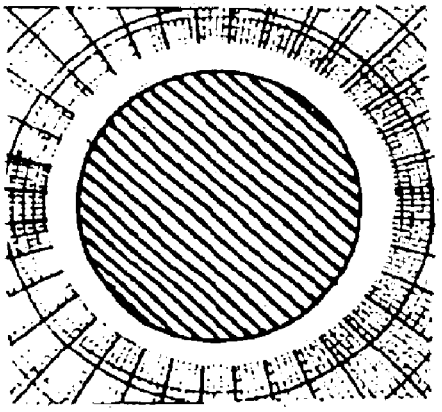
reflected off "diffuse".
Figure 2C.
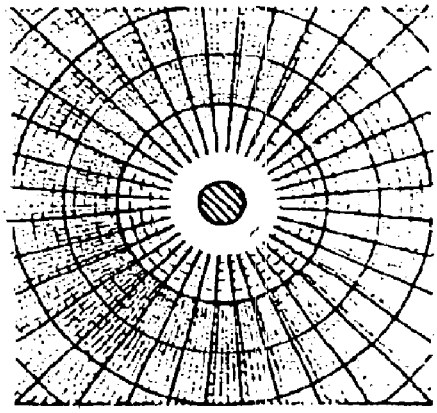
partially "restored" surface
Figure 2D Solid angle "Vector Model" for diffuse ray tracing A nested Hexagonal solid angle of equivalent area, and shown at approximately 7 X scale Figure 4. Directing diffuse cluster about P1 from D1
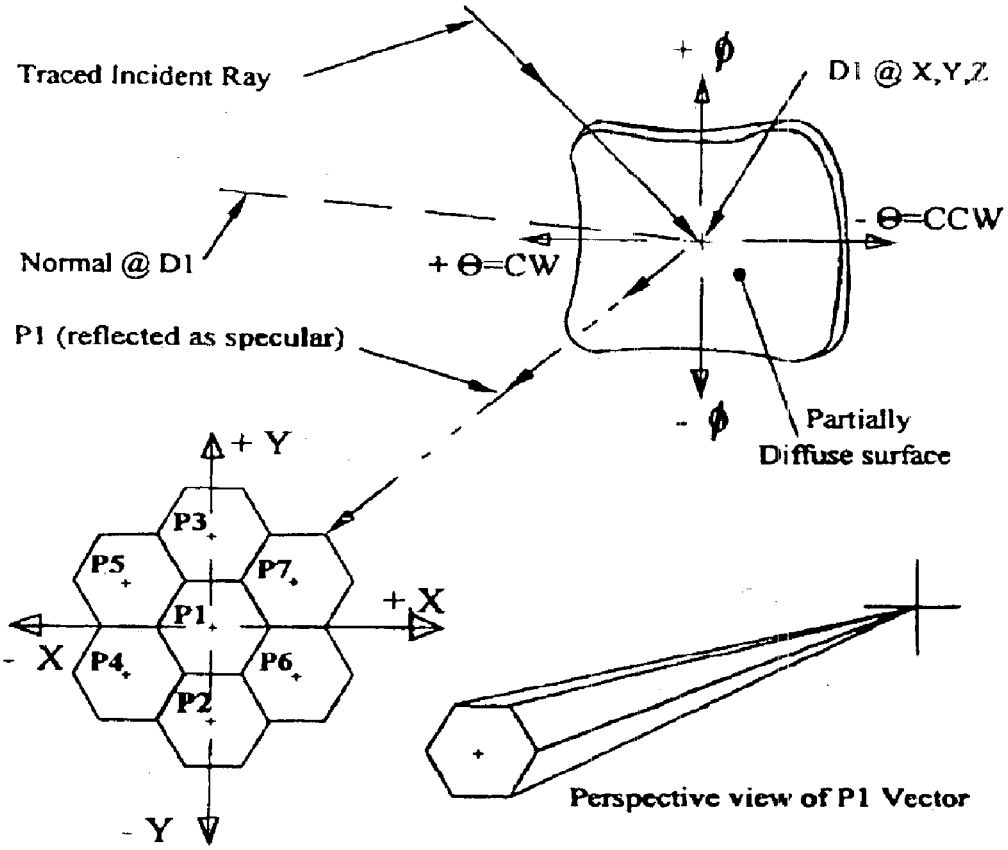

CONTROLLING SPECULARITY OF LUMINAIRE AND OTHER REFLECTORS TO OPTIMIZE THEIR OPTICAL PERFORMANCE

BACKGROUND OF INVENTION

This invention relates to providing major improvements to reflectors over present methods. These reflectors are used in Luminaires in the fields of area illumination for safety, recreation, residential and industrial needs. Benefits of this invention can also be applied to any field of applied optics using reflection where a controlled and consistent distribution of specularity is required. Below is a list of granted patents the inventor is familiar with and believes this invention is applicable to providing significant and consistent improvements to those patented inventions still active and of course to any new or like subsequent inventions.

U.S. PATENT DOCUMENTS

| U.S. Pat. No. | Grant Date | Inventors |
|---|---|---|
| 5,586,015 | December 1996 | Baldwin, et al |
| 5,014,175 | May 1991 | Osteen, et al |
| 4,358,816 | November 1982 | Soileau |
| 4,303,971 | December 1981 | Hogue, et al |
| 4,280,170 | July 1981 | Baldwin |
| 4,254,456 | March 1981 | Grindle, et al |
| 4,186,433 | January 1980 | Baldwin |
| 3,975,936 | August 1976 | Baldwin, et al |

The design challenge common to all reflector applications is to use each part of the reflector surface to intercept an amount of radiant energy from a source and reflect it through the reflector opening and directly to the area to be illuminated. That challenge is more easily met if the majority of the reflections are specular. But, with prior art, formed shapes, and the accompanying specular reflection required is seldom achieved.

One of the most disturbing factors resulting with prior art is that often discrepancies arise between the expected design results and the measured performance. Yet, it seems everything planned was done normally and nothing seemed to have gone awry.

However, it would be reasonable to assume that something physical in the overall reflector manufacturing, perhaps unknown, unsuspected or overlooked must be the cause of those occasions. That guiding question suggests a new review of all the existing prior art to identify any possible hidden or overlooked mechanical cause of those occasions. Therefore a short historical review of the technology and related background was done to identify any unknowns. This was done in two steps to better understand the prior art. First an "overview" was made of today's product manufacture and the apparent results. Secondly, a more "detailed" view and experimental observations of the reflection behavior of the presently formed surfaces with an attempt to find a means to quantify that refection behavior.

Overview: The earliest of Luminaires were made shortly after Thomas Edison invented the first incandescent light. Their objective was to use the lost upward light and return it to the workplace.

As improvements in lamps were developed, reflector designs evolved as did manufacturing technology with new forming methods. They began from wrapped flat circular or fluted surfaces into shallow cones. Later, stamped, or spun surfaces, some metal die cast and finally the present popular system of Hydro forming complex 3D shapes. For that, flat rolled Aluminum sheet evolved as the material of choice. It's high reflectivity in the visible spectrum, even higher in the IR, ductility that permits it to be stretched formed into the complex shapes, lightweight but with adequate strength and its low cost were the main factors.

For the last forty years, the expansion of the nation's roadway systems required volume production of roadway lighting fixtures. That was followed by similar growth results from outdoor and indoor applications. As the industry matured, the quantities of reflectors increased. So did the economic demand to use the source light more efficiently and for longer lifetimes.

As the overview above suggested, the following comments resulted primarily from a hands on feel and look of several reflector samples made under the present technology. One sample set were the raw formed parts, with flange trimmed and with holes punched for mounting the lamp socket. Another reflector was a fully formed and finished part with cleaning, brightening and an overcoat of a clear and inert surface added for protection. This overview examination yielded these typical observations.

The finished forms surfaces appeared smooth and continuous, inside and outside and appeared normal to the unaided eye. Also, to the unaided eye, the reflector's "exterior" surface appeared smooth even after the punching step. However, to the eye again, the reflector's exterior surface, appeared somewhat smoother (a qualitative term only) than the flange exterior and a bit brighter. In a form having facets, the facets appeared flat and even smoother. When formed curves are viewed carefully, their surfaces show the tool markings that generated the curvature. That obvious difference is perhaps more easily explained if one remembers a detail or two of the Hydro form process. In that process, a reflector blank sheet is stretched and wrapped around a steel tool to generate the reflector form. Controlled pressure is applied against the blank on the outside of the tool and comes through a flexible and conforming diaphragm with controllable pressure in the chamber behind it.

Occasionally near the reflector opening, a few bright small areas were observed. Upon closer examination, these small spots appeared to be drag marks rubbed onto the reflector surface resulting from removal of the formed reflector from that part of the tool. Though those drag marks appeared to the eye as brighter, a later test did not show them to be specular. The overview examination yielded little insight except that reflection behavior was still the suspected cause for the discrepancy between design and results as noted earlier. For a more detailed examination of the prior art, the full focus was centered on a deeper understanding of the reflecting surface. In fact, the search was for a physical replication of Snell's Law from these processed reflector materials.

Detailed Examination: This examination began with a search for a geometric definition or meaning of the terms involved. During this industry's long successful history, the term "Specularity" evolved as a commonly used qualitative term. It was often preceded by an equally non-illuminating term, "essentially". It had many convenient connotations but seldom was an attempt noted to define specularity, or the lack of it, in a measurable and repeatable manner. One item common to all the above but mentioned only in the most obvious terms was the "reflecting surface". It was often implied, suggested or defined to be essentially specular unless some particular application required the reflection to be diffuse. Clearly, a more detailed understanding of the surface was needed.

The priority for this test was to first prove the basic assumption that a specular surface would reflect a specular beam. To do that a short, square tool steel block, hardened to a minimum hardness of (Rockwell C-40), was ground, polished and buffed until it had a flat and mirror like surface on the upper side. Details of adjacent objects in daylight were clearly visible when imaged in the polished surface. When the tool was placed to intercept a fixed laser beam, the beam's reflected image appeared on the ceiling as a small bright spot and appeared the same as if the laser were pointed upward. When the specular laser beam was reflected to pass directly through the center of a translucent screen, the edges of the reflected laser beam appeared circular in cross section as did the beam. However, when the laser was reflected from any flat part of an unfinished production reflector, it was impossible to find the reflected beam on the ceiling.

That experiment confirmed the laser and the polished tool surface could demonstrate specularity. And, what appeared to the eye as a diffuse reflecting surface showed the total absence of any specularity. The setup so far, in principle, was acceptable and the model "Solid" was chosen as the appropriate geometry. The reason behind this choice is that the solid angle concept so realistically replicates the behavior of reflections of laser beams in actual testing and permits the opportunity to produce a measure of the order of magnitude as will be seen later.

The translucent screen, made from polar coordinate plotting paper, mounted in a cardboard frame was placed perpendicular to the reflected beam to intercept it about 9 inches away from the point of incidence. The pattern of polar plotting paper is a series of concentric circles of increasing radius with the inner one being ⅛ inch diameter. The concentric circular pattern was also divided by radial lines through the center. The screen frame was then adjusted until the laser's incident beam, reflecting off the specular tool. permitted the reflected specular-beam to pass directly through the center of the screen.

With the setup now having the capability to show total specularity, a mix of both, or the lack of it, the test setup was ready. The small production samples, mentioned above, were then placed to intercept the beam. The intent was to confirm and document that different degrees of specularity produced different reflection patterns on the screens geometry as they did. The results of the 3D setups and test surfaces are shown in four front views of four different reflection patterns. The individual different reflection surface setups are shown below in the FIGS. 1A–1D.

But, a question remained. It was the desire and need to check the differences in the screen pattern caused by the subsequent process of cleaning followed by chemical brightening. A just formed sample was washed with a mild soap and water, treated with a commercial Aluminum brightening chemical, ALUMIBRITE, (sold as an Acidic Cleaner Brightener) and then subjected to a laser beam reflectance test before and after. The brightening made the sample appear brighter to the eye but under the laser test, showed no gain in specularity. The preliminary conclusion of the laser beam experiments on parts from prior art manufacturing is that the residual specularity of the surfaces inside the reflector are the result of the extensive forming stresses which appear as relatively smooth to the eye and hand but at the dimensions of the wavelength of light in the visible spectrum, the surface appeared significantly deformed. At low magnification, 12.times. to 30.times., the surface looked like soft hilly terrain with relatively low altitude, wide base convex curves with random orientation and of relatively uniform size. When examined at higher magnifications (100.times. to 200.times.), the change from a flat sheet appeared much more significant. However when a laser beam was aimed at the surface, the reflected beam had spread so broadly, and apparently uniformly, it was impossible to tell where it went because neither, screen, ceiling or walls captured any visible beam fragments.

To confirm a possible cause for the surfaces disruption, six length measurements over the forms exterior were taken in a clockwise manner with 12 o'clock in line with the street side. Lengths across the flat flanges centered radially, then across and over corresponding angular paths of the formed part. These measurements showed stretch extensions several times beyond the material's elongation failure limit.

For example, the total stretch of the six blank diagonals to the formed lengths varied from 64% to 81% with an average linear stretch diagonally of 70%. Though the ultimate tensile strength was easily exceeded, the constraints of the tool, the possible use of an earlier reverse stretching, and the limited movement set by the forming diaphragm and the tool, all managed, with operator skill, to deliver a completely formed reflector having apparently adequate (and whole?) residual thickness. Actual thickness measurements of the removed samples show a typical reduction in original thickness, in the range of 5% to 25%, depending on the sample's position where removed. Metallurgical examination at magnifications of 100.times. or greater from edgewise cuts and encapsulated samples clearly showed a tortured multi-angled reflector surface.

Looking down at the reflecting surface from above, an observer could also see many depressions, folds, dents and small cavities. These observations substantiated the reason why much of the light energy as well as specularity is lost at each reflection from such a surface. Higher magnifications of the order of 300 .times., viewed with a binocular microscope showed the, as formed surface, as a rough graveled surface being littered with large rectangular blocks in random floating positions and some even partially submerged. They appeared to be crystal like in the uniformity of their shape, with the included angles of their sides, ends and surface of the blocks, all approximating 90 degrees.

In a search of patents of prior art related to reflectors for Luminaires, no references were found to claim the concept that a tailored reflection pattern on a tool could be used as a final mechanical process to control the proportion of Specular and Diffuse reflection. No references were made to using a mechanical method to press a tool against and into the reflector surface and set it as the final mechanical act to control specularity. Nor were any claims found to set the desired reflection properties just before chemical treatment so that any brightening treatment could be optimized to enhance specularity and reflectivity rather than possibly degrading the desired finish. And, lastly no references were found to suggest that solid angle geometry could help quantify the degree and repeatability of specularity.

SUMMARY OF INVENTION

The object of this invention is to provide significantly improved optical performance consistently in the manufacturing of reflector shapes, with contour and surface specularity defined beforehand. The desired degree of specularity is applied about the tool's form. Then, in the final stages of the forming process, the controlled specularity on the tool is transferred permanently to the reflector's interior as in the manner somewhat similar to "coining". This is done by generating the desired specular surfaces on the exterior of a sufficiently hardened steel tool to be used in the Hydro form process. Specularity of the desired degree is to be set and tested by a laser at each required mating area of the tool's surface before a production reflector is formed. It is a further object of this invention to define the relative degree of reflectance specularity geometrically as producing different "solid angle" patterns from a laser beam.

BRIEF DESCRIPTION OF DRAWINGS

In the attached drawings the object is to show the changes in light patterns from a reflected laser beam's geometric behavior leaving different surfaces and that behavior measured and defined numerically as specific solid angles.

FIGS. 2A–2D. Show pattern sections of the above four beams for comparison and obtaining measurable diameters of the reflecting beams at their interception with viewing plane and centered on the target screen pattern. The diameters are shown hatched and are measured at equal distance from the reflecting surface and at full scale.

FIG. 4. Provides aiming guidance for the nested hexagonal representation of the diffuse elements to improve the validity of a ray tracing analysis for diffuse surfaces.

DETAILED DESCRIPTION

Figure 1A:
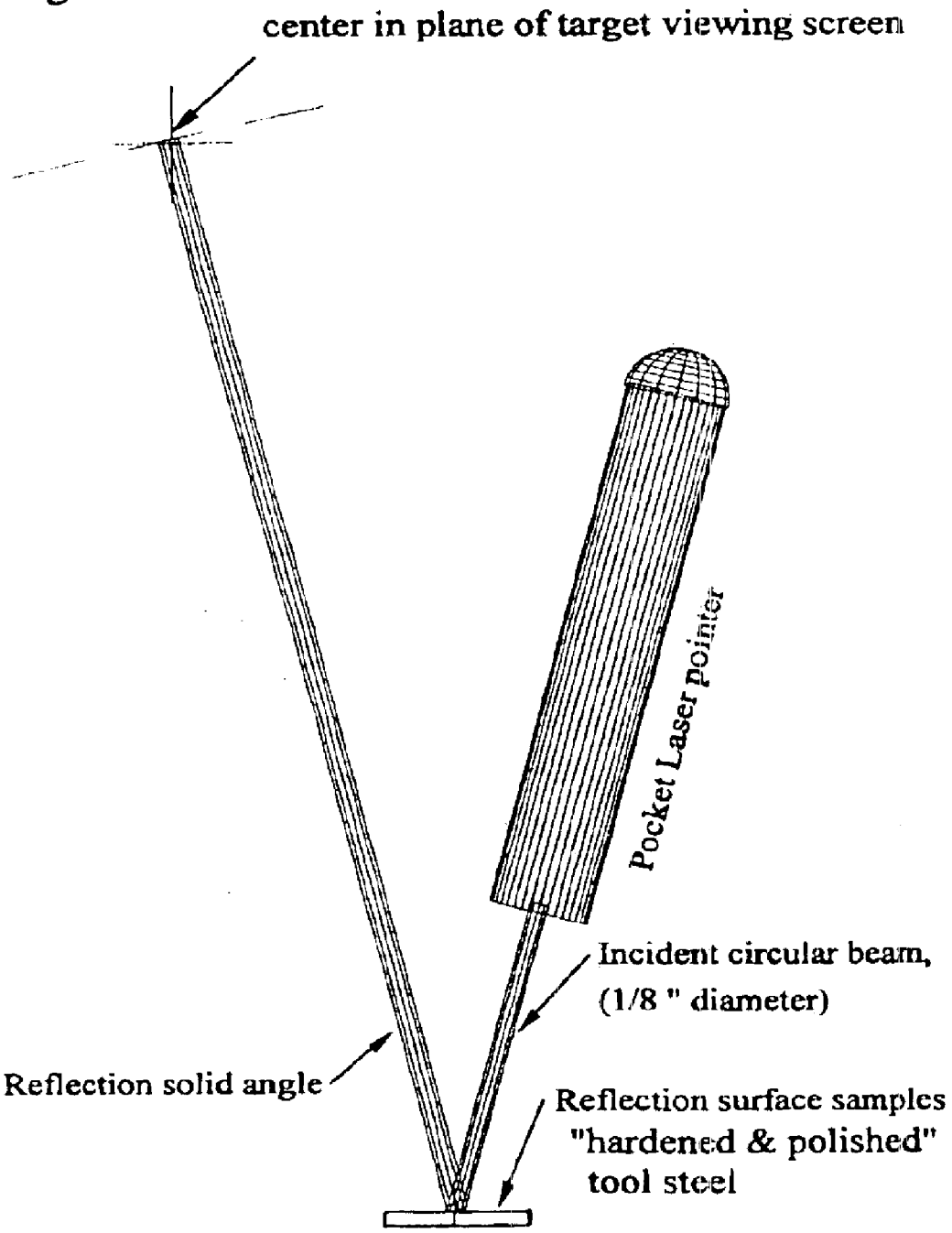
FIG. 1A. Illustrates visually the reflection performance of a sample laser beam from a specular tool surface. The solid angle is very near zero.

This invention can be best understood by observing that the present process does not adequately provide the most critically needed element. The reflector's surface has been almost totally destroyed optically while the desired form has been shaped. Unfortunately, the product, when judged by the eye and hand feel, appears to be acceptable. But, only by a significant and proper mechanical action will a suitable optical surface be recovered and yield the desired results. This corrective action will mechanically and permanently transfer the controlled specularity previously put on the/tool's surface to the reflector.

A liquid lubricant will not impair the transfer of specularity from the tool to the reflector. A compressive stress of about 5,000 psi is sufficient to cause compression yield in most aluminum sheet alloys used as reflectors. With the timing proposed for the surface transfer, the stresses distributed in the reflector material about the form and tool, are likely already close to that yielding stress value.

The detail description of the observations of the as formed surfaces under high magnification showed the surface with scattered rectangular crystal like shapes. Further as well, the observation that flat compression against a specular steel surface all occurred in a total compression yield dimension of only about 0.001 to 0.002 inches. These facts confirm that a pressure pulse or compressive force of some short duration is easily within the capability of the Hydro form equipment. Chemical brightening, etching or other smoothing chemical processes may appear to improve the optical performance but they may not improve the specularity, they might even decrease it. A laser beam test showed the loss of specularity from one of these processes. However, if a desired process passes the laser test, it would be acceptable. Chemicals may remove the adjacent surface but are not known to be selective in smoothing high spots and not low spots. They appear to always act perpendicular to the wetted surface. Therefore, this final process step is an ideal time to recover the surface optically. It is at the final moments of forming and at that time, providing the acceptable level of specularity is already on the forming tool, proves to be the ideal mechanical means. Such timing can eliminate product handling, more tooling, etc. However, to do that, specularity must be controlled. Surface finishing and protection need to be re-examined by laser reflection, not just by eye. If the reflector surface is specular and controlled, cleaning and application of a protective coating in liquid form should not significantly affect the specularity.

The reasons for the process changes, improvements and evidence as well as proof of the invention came from actually executing the process and then observing their reflection behavior of the samples taken. The explanatory text below and the results are illustrated in the accompanying Figures. They are described in detail for each of the Figures attached and the accompanying measurement are listed in the Tables.

Each of the Figures shows the reflected beam's pattern symmetrically intercepted at the screen center. The screen was cut from a sheet of translucent polar plotting paper, suspended and tilted, to intercept the reflected beam at a fixed distance of 9 inches from the sample and to be perpendicular to the reflected beam. The beam appeared to be of uniform energy per unit angle. FIG. 1C is a special diffuse case and is also shown as a crosshatched section. That diameter was measured where there seemed to be a noticeable change in falling off of the brightness across the beam. The paragraphs below define the samples, process conditions and results.

FIG. 1A. Reflection of a laser beam from polished Tool Steel. This drawing shows the beam aimed downward from the laser at lower right. The beam is aimed at the hardened tool steel block on the polished side. From there it reflects to the underside of the screen. The image of the lasers reflected beam also passes through the translucent screen and can be seen exiting at the screen center. There is some level of scatter as the beam enters and leaves the screen, but its effect is negligible. This figure illustrates that the tool's polished and specular surface causes negligible loss of specularity as claimed.

Figure 1B:
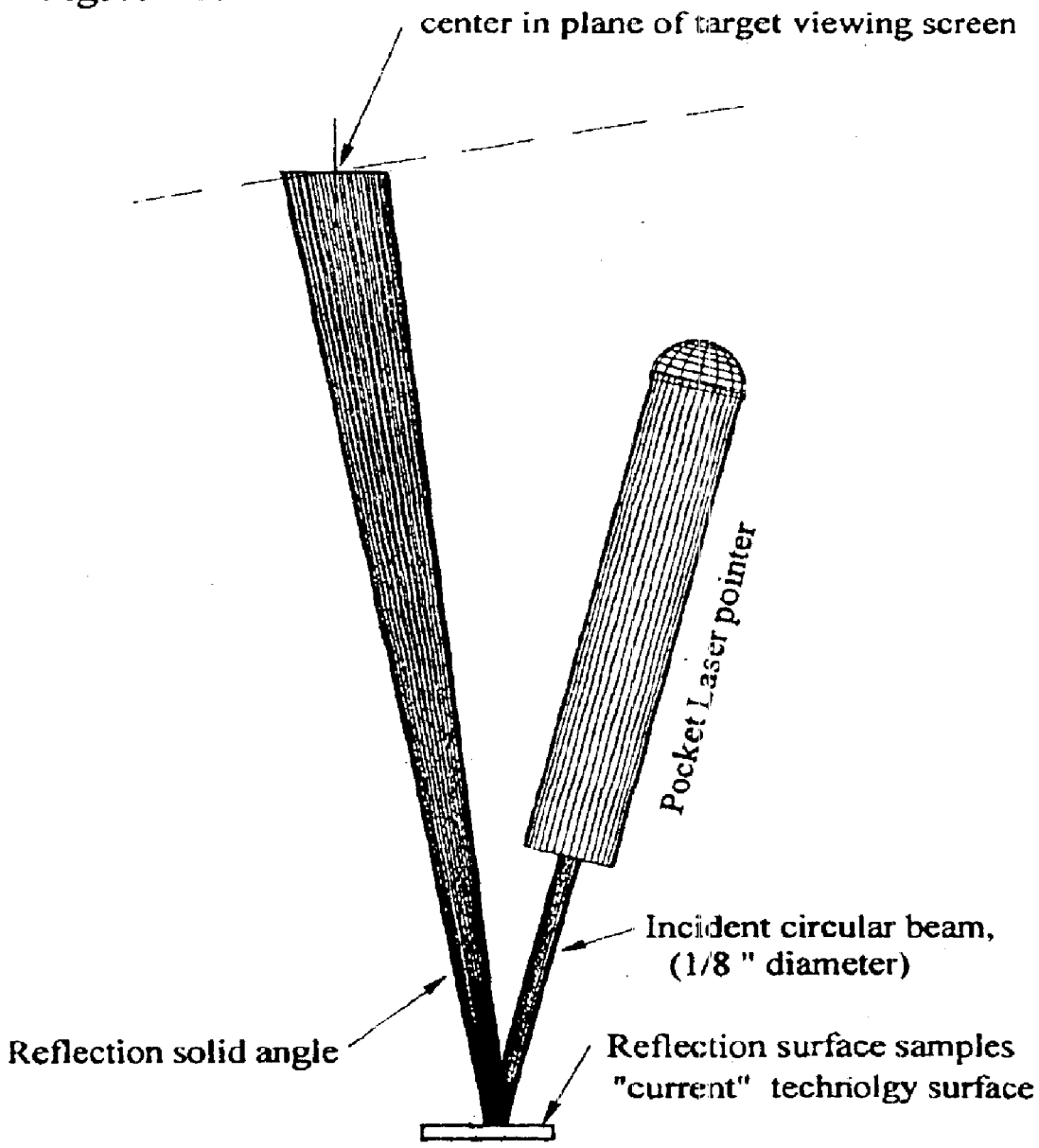
FIG. 1B. Shows the actual loss of specularity of a reflector surface made using present art.
Figure 1C:
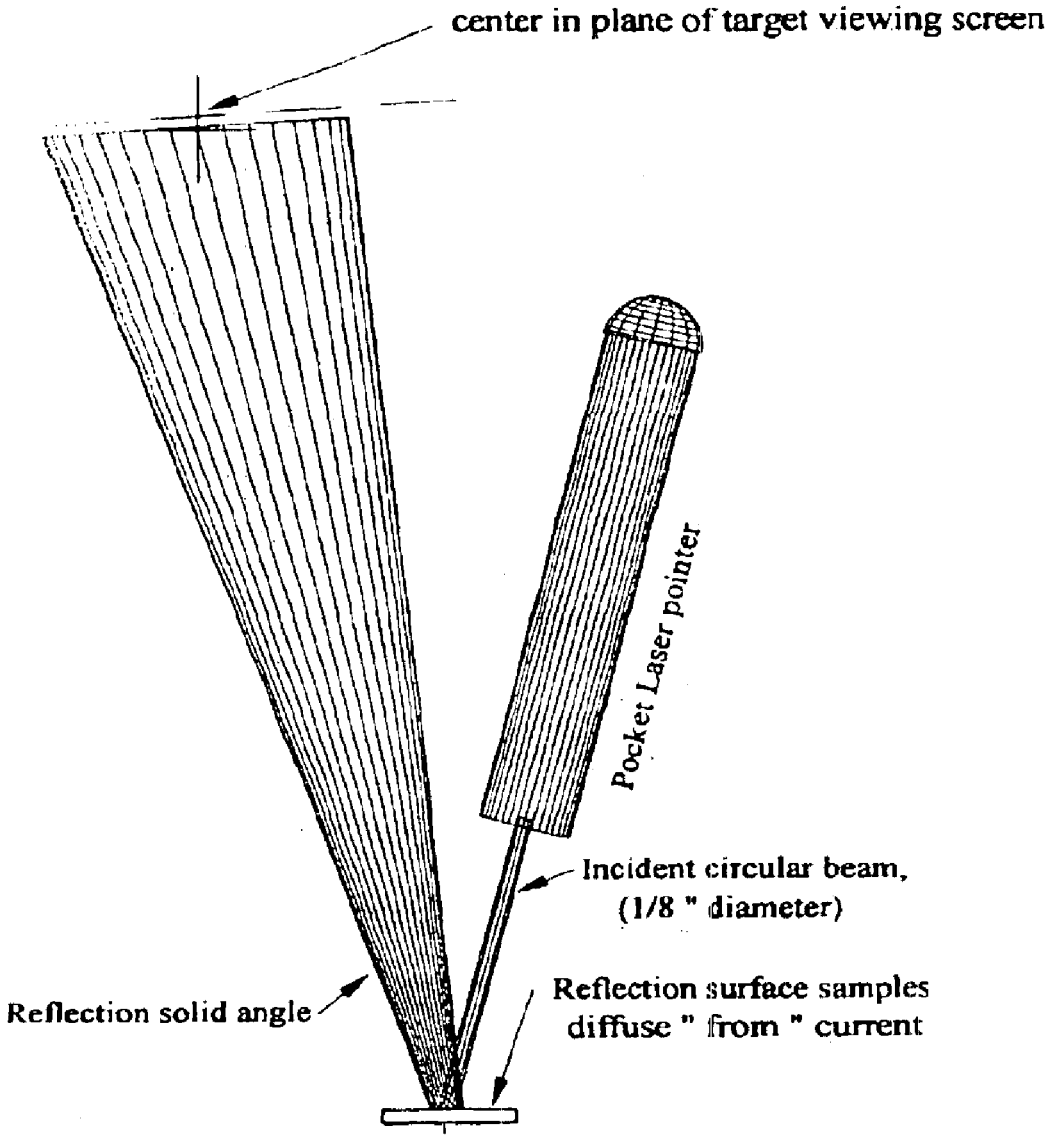
FIG. 1C. Illustrates the reflection performance of the reverse and diffuse side of the sample, above, with almost total loss of specularity.

FIG. 1B. Current technology reflector sample. This drawing shows the laser beam aimed downward as before in FIG. 1A. This sample was taken from about the center of the reflector longitudinally and at about the lamp arc's center. The beam, in the figure, is aimed at the center of the reflector flat sample and reflects off the inside surface. From there it reflects to the underside of the screen. As above, the image of the reflected beam is represented as shown. This figure illustrates the loss in specularity using the current technology. It also illustrates the solid angle behavior. After forming, the reflector sample was washed, chemically brightened and coated with an inert protective coating.

FIG. 1C. Sample is again 1B, but the beam is aimed at the outside of the reflector surface. This sketch shows the laser beam aimed downward as before in FIG. 1A. The drawing shows no significant specularity. There is scatter at the point of incidence, not seen on previous samples, but most of the beam is brightest out to the largest circle on the screen. It is assumed that the area for this solid angle has that approximate diameter. Though this outer surface has low specularity, it is a product advantage when used here because it will help radiate, via "infrared", the excess heat generated in the reflector to the outside housing and is provided at no extra cost from the Hydro form process.

Figure 1D:
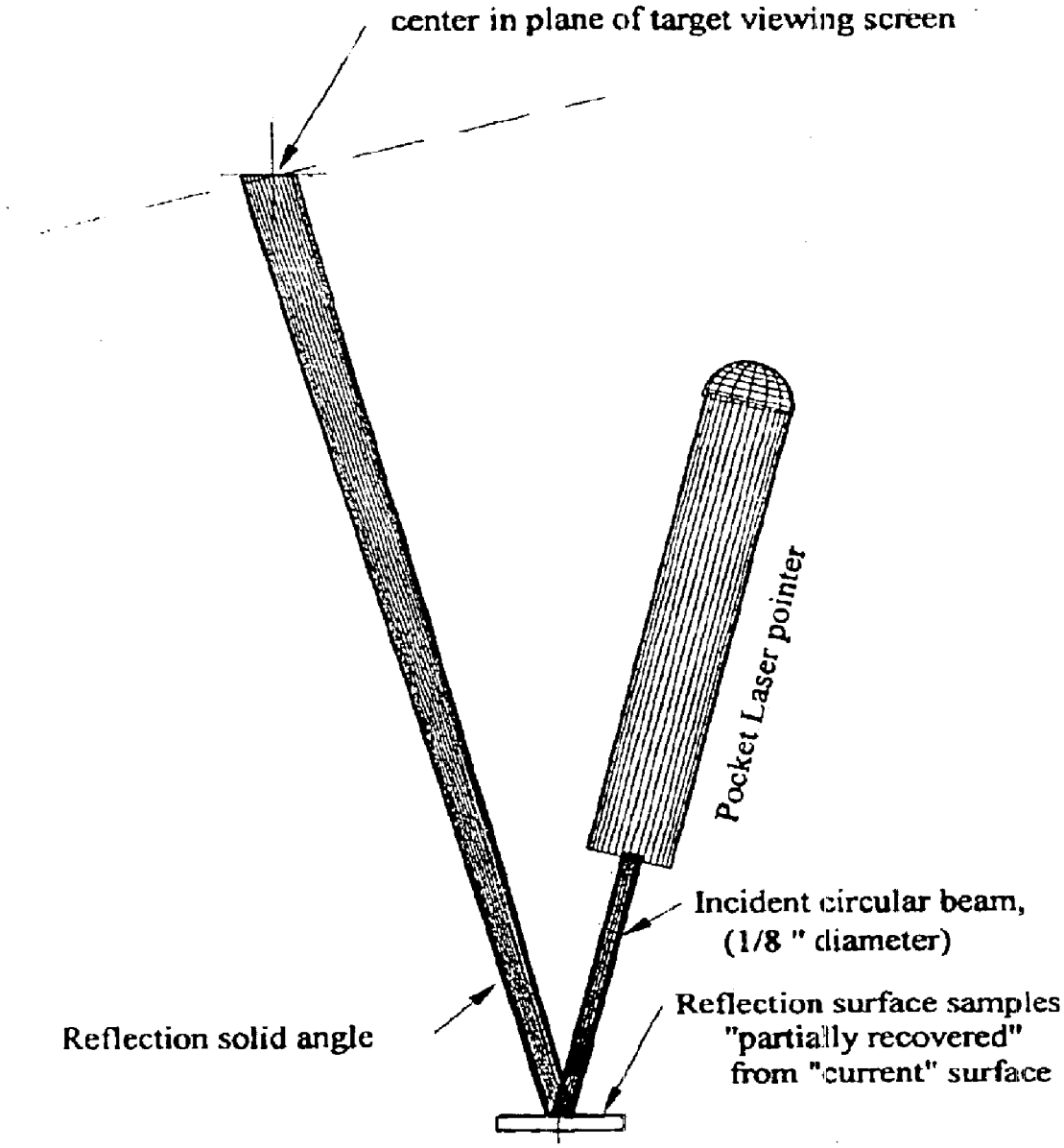
FIG. 1D. Illustrates the recovery of much of the specularity shown in FIG. 1B caused by forcing a portion of that surface to conform to the specular (tool) surface.

FIG. 1D. Current technology reflector sample with specularity "partially recovered". The sample in FIG. 1B was modified in the following manner. A corner portion of the polished portion of the tool was placed against the reflecting surface over the sample's corner and with an area sufficient to collect the full incident beam. The overall thickness of the tool and sample were then measured. Then a force was applied to cause the sample's reflecting surface to compressively yield and form against the tool over the area of contact. The combined thickness of the sample and tool only decreased between 0.001 and 0.002 inches, indicating the sample had been compressed on both the outside and inside surfaces somewhere in that total range as the hardened tool's initial dimension remained the same. The recovery of specularity shows the significant improvement towards the specularity of the laser reflecting off the tool itself.

To add final proof of the concept, the improved specularity result shown in "restored" image is, in spite of the fact, that the compressed surface included fractured pieces of the inert transparent surface and its remnants as part of the measured result. These results show a significant improvement in recovery of lost specularity previously shown in "current" practice.

Comparative results. The key critical tests above and their visual and measurable results are shown in FIG. 2. The relative beam diameters are shown as the crosshatched diameters of the beam at the screen center. Under each beam view, the "source of the reflected beam" is noted. They are all shown at full scale.

Summarizing the results of examining FIG. 2: Viewing clockwise from top left, one sees an image of full specularity of the laser beam reflecting from the "steel tool" as a truly specular surface. Next, at right, the image "current tools" shows a sample from a current production reflector and present processes. Back to lower left, the image "diffuse" demonstrates the maximum measurable loss in specularity from the setup. This diffuse surface was formed by the Hydro form diaphragm pressing the reflector blank against a normal tool surface. And, at the bottom right, the image, "restored" shows the resulting specularity improvement from pressing a small area of the polished tool against the "inside" surface of the production sample. It demonstrates a major recovery of specularity over the results of "current" procedures.

Those views also provide the diameters of the beam for the area factor needed in the solid angle definition. In fact, if the areas are squared, the solid angles can be compared directly since the distance "r, squared" is a constant through all measurements. In summary, specularity is maximum if the solid angle approaches or is zero. And, with loss of specularity, the solid angle increases. The maximum theoretical solid angle that can exist about a point in space is 4(Pi) Steradians.

To measure the different reflection patterns with more accuracy, the patterns of the beam at the screen distance were measured and tabulated and are shown below. Those screen views are shown as diameters and are labeled as from their "reflecting sources". Those results and the calculated solid angles are shown below in Table 1. Also, there are additional significant and beneficial physical product changes from restoring the optical surface in this invention. That compression to yield action improves the whole remaining and variable thickness of the reflector. That force also flattens random surface folds and closes cavities, giving increased optical reflective area, improved strength, higher chemical resistance, better thermal conductivity and a surface whose density is more uniform and approaches its original sheet value. It also provides a level surface for any acceptable protective coating by providing a more uniform film thickness base. The solid angle analogy is demonstrated in each of the above tests and their numerical value confirms the relationship that non-specular reflection can be represented in a new, more accurate, and useful way.

TABLE 1

2/31 Beam diameters and solid angles from different reflecting surfaces:

| Source of reflection surfaces | FIG. # | Beam Diameter (inches) | Area (inches square) | Solid Angle @ r = 90 in. (Steradians) | Ratio to Specular Solid angle |
|---|---|---|---|---|---|
| Specular tool | FIG. 1A | 0.125 | 0.01227 | 0.000122718 | 1.000 |
| Std. Product | FIG. 1B | 0.65 | 0.33183 | 0.003318307 | 27.04 |
| Std. Product (back side) | FIG. 1C | 1.865 | 2.73179 | 0.027317915 | 222.0 |
| Recovered (back of Std. FIG. 1B) | FIG. 1D | 0.250 | 0.04909 | 0.000490874 | 4.000 |

In the course of developing this invention, it also became more insightful as a valid geometric expansion connection to the normal vector analysis involved in ray tracing programs. This new tool for photometric design can now permit a limited but valuable ray trace of energy that is otherwise lost when a ray encounters a diffuse surface. To help visualize the proposed Vector model, see FIG. 3.

At the top left is a graphic showing a vector intercepting and reflecting from a diffuse surface. The reflected rays are normally considered to be going in all directions, but we have just demonstrated they fit the behavior pattern and definition of a solid angle. If we use the solid angle concept and maintain an area in our model from Table 1, we can choose an area of a tolerable level of non-specularity. The first step is to define the maximum acceptable solid angle. That can be done from a review of the screen images in FIG. 2. That would be represented by a circle whose diameter was equal to the diameter shown as Diameter 1B at 0.650 inches. The proposed model would be 7 clustered conical shapes of equal length and a combined cluster area to provide the equivalent area of the beam circle of area, (0.33183) inches squared, shown in FIG. 1B. Each of the seven cones having an area in the plane of the screen of 0.0474 inches squared. The equation of solid angle, see Solid, has no units since they cancel. It defines the numerator as "area" but not shape, therefore any shape positioned of equal area and the same distance from the reflecting surface has an identical solid angle.

Figure 3:
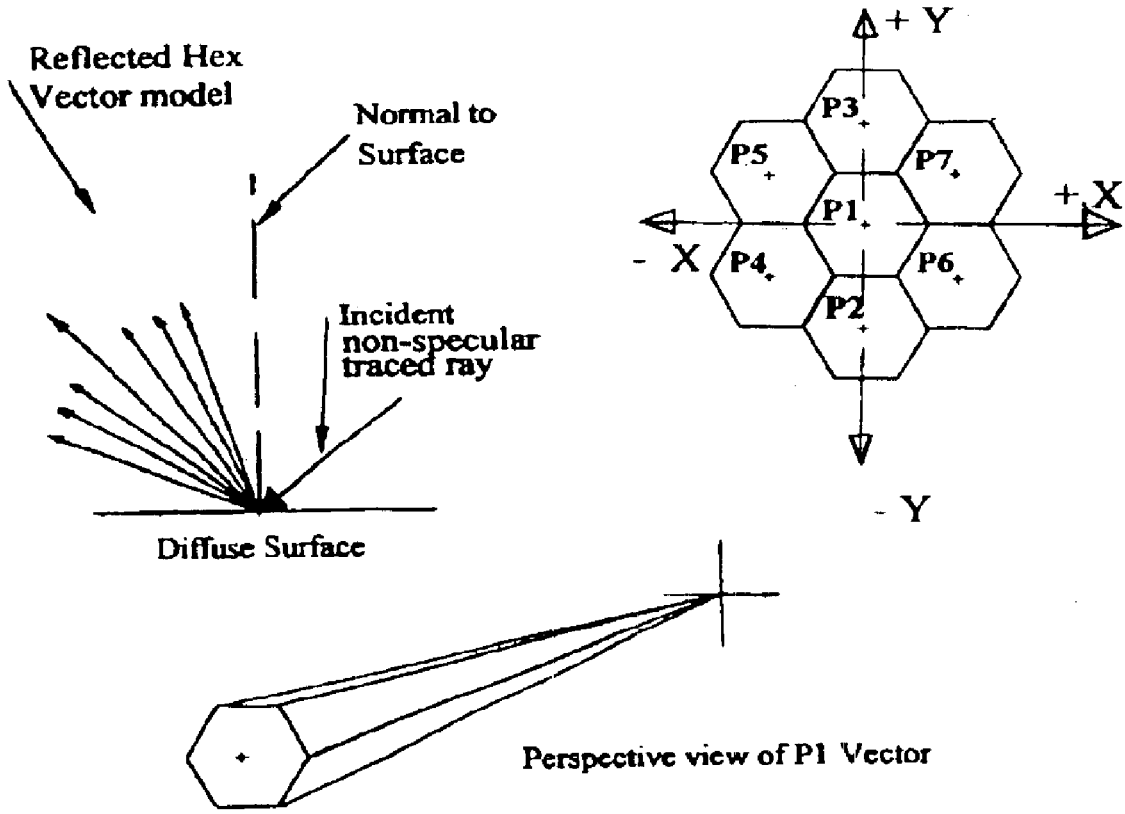
FIG. 3. Vector Model-Solid Angle for non-specular surface ray tracing.

With that, a cluster of hexagonal shaped cones consisting of one at the center surrounded by 6 matching hexagons is proposed and is shown in FIG. 3. It is a view of the physical model. This permits a reflected ray to be traced in a subroutine and fit into the analytical design model and later provide a more realistic comparison with measured results. In normal ray tracing, a ray incident upon a surface reflects as a ray with the constraint that the reflection angle equal the incident angle, and both are in the same plane as the surface's normal at the point of incidence. That is well recognized as Snell's Law in optics.

What is being proposed in this invention is a vector model for a reflection behavior less than specular. If the surface encountered by a specular ray from the source encounters a diffuse surface, the reflected ray model proposed represents the maximum permissible solid angle compatible model illustrated in FIG. 3. The coordinates of the centers of each of the hexagons are tabulated in Table 2.

TABLE 2

Coordinate values for cluster centers shown in FIG. 3.

| Position | Direction to Next | X Coordinate | Y Coordinate | Units |
|---|---|---|---|---|
| 1 | Central | 0.000 | 0.000 | inches |
| 2 | South | 0.000 | −0.234 | inches |
| 3 | North | 0.000 | +0.234 | inches |
| 4 | WSW | −0.203 | −0.117 | inches |
| 5 | WNW | −0.203 | +0.117 | inches |
| 6 | ESE | +0.203 | −0.117 | inches |
| 7 | ENE | +0.203 | +0.117 | inches |

It is shown as a cluster of six conical shapes centered about a similar sized and shaped cone P1 aimed along the specular path. The cone cluster would have a hexagonal pattern of a total area A at the plane of the screen and a length "r" from the point of incidence. Their ends would have an individual area equal to A divided by 7.

This symmetrical cluster of hexagons is proposed as the makeup of the non-specular reflection model. The reason is that if the total area of the pattern of FIG. 3 were maintained as close to the combined area of the seven small hexagons, each would have one seventh the pattern area and have a balanced distribution about the center of the first incident ray upon a diffuse surface. Each of the six rays leaves the incident point in a different but symmetrically nested direction to be described later.

Most analytical software using ray-tracing techniques usually start with all the points of the reflector surface having unique X, Y and Z coordinates relative to the origin. The source is also referenced to the origin. To the reflector surface matrix of coordinate values, there would be added a code to indicate that coordinate point was located on a specular or diffuse area. Also, each point of the reflector opening would have its own coded set of coordinates such as X", Y" and Z" relative to the same origin.

Finally, the surface to be illuminated also has coordinates relative to the origin and some distance away. If in the course of design or evaluation, a ray from the source intercepted a specular point, the software would compute the direction of the perpendicular passing through that incident point and compute the incident angle made by the incident ray. It would then move the direction of the reflected ray to the correct direction. That would be in the plane containing both the incident ray and the normal, and be given a reflection angle equal to the incident angle. And, then proceed to the next point on the surface that the first reflected ray intercepts. This would continue until a subsequent reflected ray passed through the opening.

At that first reflection and any subsequent reflections, the magnitude of the incident ray would decrease by a factor related to the reflectivity of the material. It should be noted here that an incident ray-encounters less loss from a specular surface than from a diffuse one.

Before proceeding to another reflection, the magnitude of the ray would be compared to a pre set minimal value. When it reached that minimum value before leaving the opening, the tracing of that ray would stop and a count made for a lost ray. The program would then proceed to the next point on the source and continue the tracing routine. Without trying to describe the intricacies of such software, the steps of word logic will continue to be used to describe the remaining steps showing how the results are tied to the surface effects.

When a ray from the source arrives at a point with a reflection code "D", it would enter the subroutine. There, it would follow the previous steps as though specular, through all the steps including the refection angle as if specular and temporarily record the coordinate values of that point as D1 coordinates. It would then compute the normal and the reflection angle and would proceed to the next intercept point. It would carry the vector forward at ([fraction (1/7)]) magnitude of its arriving value minus that first reflection loss. Then test the resulting value against the minimum acceptable. If it did not intercept another "D" surface, and or had a magnitude higher than the minimum, it would proceed as specular. If not, then the tracing would stop and be recorded as lost. The program would then return to the coordinate points of D1 and step through the relative geometry and step sequence shown in FIG. 4.

From there the interception of the first ray (above) to encounter D1 would be aimed in a slightly different direction before proceeding to find the next interception point on the reflector. That change in direction would be referenced from the same direction as the reflection ray P1 that first left from D1, in FIG. 4, and modified as directed by the coordinates shown in Table 3 below for Position P2 and so on to Position P7 for each of the six surrounding vector directions as shown in the cluster.

From there the interception of the first ray (above), to encounter D1 would be aimed in a slightly different direction before proceeding to find the next interception point on the reflector. That change in direction would be referenced from the same direction as the reflection ray P1 that first left from D1, in FIG. 4, and modified as directed, by the coordinates shown in Table 3 below for Position P2 and so on to Position P7 for each of the six surrounding vector directions as shown in the cluster.

The reflection vector from point D1 calculated above and traced would also be the direction of the principal ray from the cluster from position P1. Each new Position would be rotated horizontally, by an angle "Theta", and vertically by and angle "Psi".

After moving the new direction plane to include the new reflection vector and the Normal, it would the be extended again until the reflector surface was again intercepted.

As each component is managed through the diffuse reflection, most of the diffuse energy will have been accounted for. When Position P7 has been traced and completed, the program would return to the coordinates of D1 and leave the subroutine. It would then return to the next point on the source to begin another trace.

TABLE 3

Aiming guidance to re-aim each of the Position vectors relative to P1.

| Vector | Radians | Degree | Radians | Degree |
|---|---|---|---|---|
| P1 | 0.000 | 0 0' 0" | 0.000 | 0.000 |
| P2 | 0.000 | 0 0' 0" | +0.0234 | +1 20' 26.6" |

TABLE 3-continued

Aiming guidance to re-aim each of the Position vectors relative to P1.

| Vector | Radians | Degree | Radians | Degree |
|---|---|---|---|---|
| P3 | 0.000 | 0 0' 0" | −0.0234 | −1 20' 26.6" |
| P4 | −0.0203 | −1 9.0' 51.2" | −0.0117 | −0 40' 13.3" |
| P5 | −0.0203 | +1 9.0' 51.2" | +0.0117 | +0 40' 13.3" |
| P6 | +0.0203 | −1 9.0' 51.2" | −0.0117 | −0 40' 13.3" |
| P7 | +0.0203 | +1 9.0' 51.2" | +0.0117 | +0 40' 13.3" |

As the re-aimed rays are traced through the sub-routine, each of the solid angle clustered elements are traced to their limits and their lighting contributions recorded to the end result if they are significant enough in magnitude to contribute to the results of their specular traces. The position vectors P2 through P7 account for about 86% of the energy reflected from D1 and other similar points. By working these rays through the geometry of an acceptable level of magnitude drop and change in direction, the analytical model described would show a much closer match to the testing result. The diameter of the 0.125 laser beam spreads to about 0.650 inches at nine inches from the current reflector. This is about 0.75 inches per foot of travel. Consider its spread from a mounting height of 35 feet and aimed 50 feet away horizontally. It would then be a beam of 46 inches diameter, or nearly four feet. It should be easy to see that an acceptable degree of specularity would still need to be as high as possible with a correspondingly small solid angle.

What is claimed is:

1. A method of controlling the physical distribution of reflected light from a reflector comprising:

forming a desired surface specularity on a tool made of hardened steel by grinding or polishing and/or buffing, permanently replicating said desired surface to a mating surface of said reflector by transferring the solid angle reflections of the tool by applying a short pulse of sufficient pressure increase in forming process by relatively moving an inner surface of the reflector intimately against the tool overcoming any residual forming stresses, testing the desired specularity by a laser at each required mating area by displaying the degree of reflectance specularity geometrically in solid angle patterns, such that the incident laser beam reflecting from the reflector projects a three dimensional beam collected by a detector means and displaying the actual solid angle reflection properties of the surface over a range of totally specular to totally diffuse and further by controlling real or proposed distribution of diffuse reflected light via a vector representation provided as a math model for ray tracing and recovery of portions of diffuse reflected light.

* * * * *